US012138521B2

(12) United States Patent
Chen

(10) Patent No.: US 12,138,521 B2
(45) Date of Patent: Nov. 12, 2024

(54) GOLF PUTTING SIGHT

(71) Applicant: Weiyu Chen, Shenzhen (CN)

(72) Inventor: Weiyu Chen, Shenzhen (CN)

( * ) Notice: Subject to any disclaimer, the term of this patent is extended or adjusted under 35 U.S.C. 154(b) by 234 days.

(21) Appl. No.: 17/991,240

(22) Filed: Nov. 21, 2022

(65) Prior Publication Data

US 2024/0165480 A1 May 23, 2024

(51) Int. Cl.
*A63B 69/36* (2006.01)
*A63B 71/06* (2006.01)

(52) U.S. Cl.
CPC .. *A63B 69/3682* (2020.08); *A63B 2071/0694* (2013.01)

(58) Field of Classification Search
CPC ..... A63B 69/3682; A63B 2071/0694
USPC ..... 473/218, 219, 257, 258, 259, 260–268, 473/270
See application file for complete search history.

(56) References Cited

U.S. PATENT DOCUMENTS 3,934,874 A * 1/1976 Henderson ..... A63B 69/3676 473/267
4,383,687 A * 5/1983 Wolff ..... A63B 69/36 359/872
6,500,075 B1 * 12/2002 McDevitt ..... A63B 69/3621 473/270
2006/0183565 A1 * 8/2006 Tolson ..... A63B 69/3621 473/262
2007/0015597 A1 * 1/2007 Bush, III ..... A63B 69/3621 473/270
2007/0243944 A1 * 10/2007 Paukune ..... A63B 69/3682 473/409

* cited by examiner

*Primary Examiner* — Nini F Legesse
(74) *Attorney, Agent, or Firm* — Locke Lord LLP; Tim Tingkang Xia, Esq.

(57) ABSTRACT

The golf putting sight includes a groove support, a first hinge; and a flat plate support. One side of the groove support is rotatably connected to the flat plate support through the first hinge. A first side of the flat plate support is rotatably connected to a base through a second hinge. A mirror plate is mounted in the groove support. Across-shaped aiming line is arranged on one side of the mirror plate. One side of the flat plate support defines a calibrating hole. A correcting line is on an upper surface of the base. When in use, through the first hinge and the second hinge, the groove support, the flat plate support, and the base are convenient to form a triangular shape. The mirror plate is aligned with a hole or a target, and a aiming line on a golf ball is aligned with the cross-shaped aiming line.

4 Claims, 6 Drawing Sheets

GOLF PUTTING SIGHT

TECHNICAL FIELD

The present disclosure relates to a technical field of golf devices, and in particular to a golf putting sight.

BACKGROUND

According to rules of golf, a golfer has an opportunity to manually place a golf ball and align an aiming line on the golf ball with a hole or a target on a golf course, when the golf ball falls into a putting green or when the golfer is ready to hit the golf ball. However, if a distance between the golf ball and the hole or the target is too far, the aiming line on the golf ball can be hardly aligned with the hole or the target in the distance, resulting in a lower hit rate. Therefore, it is necessary to provide a golf putting sight.

SUMMARY

In view of this, the present disclosure provides a golf putting sight to solve or alleviate technical problems in the prior art, or at least to provide a useful option.

The present disclosure provides a golf putting sight. The golf putting sight comprises a groove support, a first hinge, and a flat plate support. One side of the groove support is rotatably connected to the flat plate support through the first hinge. A first side of the flat plate support is rotatably connected to a base through a second hinge. A mirror plate is mounted in the groove support. Across-shaped aiming line is arranged on one side of the mirror plate. One side of the flat plate support defines a calibrating hole. A correcting line is on an upper surface of the base.

Furthermore, the first hinge comprises two first bending plates, a second bending plate, and a first rod body. The one side of the groove support is integrally formed on one side of the second bending plate. The first side of the flat plate support is integrally formed on one side of each of the first bending plates. An inner wall of the second bending plate is attached to an outer wall of the first rod body. An inner wall of each of the first bending pates is attached to the outer wall of the first rod body. The first bending plates, the second bending plate, and first rod body are combined to assist rotations of the groove support and the flat plate support.

Furthermore, the second hinge comprises two third bending plates, a fourth bending plate, and a second rod body. A second side of the flat plate support is integrally formed on one side of the fourth bending plate. One side of the base is integrally formed on one side of each of the third bending plates. An inner wall of the fourth bending plate is attached to an outer wall of the second rod body. An inner wall of each of the third bending pates is attached to the outer wall of the second rod body. The third bending plates, the fourth bending plate, and second rod body are combined to assist rotations of the base and flat plate support.

Furthermore, a supporting bending plate is integrally formed on a second side of the base. By an arrangement of the supporting bending plate, a height of the supporting bending plate is same as a height of the third bending plates, ensuring that the base is placed in a horizontal position on the ground.

In the present disclosure, the golf putting sight comprises the groove support, the flat plate support, and the base. The cross-shaped aiming line is arranged on the mirror plate. The correcting line is on the base. The calibrating hole is on the flat plate support. When in use, through the first hinge and the second hinge, the groove support, the flat plate support, and the base are convenient to form a triangular shape. By a principle of mirror refraction and a principle that two points form one line, the mirror plate of the present disclosure is aligned with a hole in the distance or a target in the distance. Then the aiming line on a golf ball is aligned with the cross-shaped aiming line on the mirror plate of the present disclosure adjacent to the golf ball, so that the aiming line of the golf ball is aligned with the hole in the distance or the target in the distance, thus enabling the golfer to improve a hit rate of the golf ball.

The groove support, the flat plate support, and base of the present disclosure are connected by the first hinge and the second hinge, which facilitates folding and storage of the golf putting sight, and facilitates a quick assembly of the golf putting sight.

Above descriptions are for illustrative purpose only and are not intended to limit the scope in any way. In addition to schematic aspects, embodiments, and features described above, optional aspects, embodiments, and features of the present disclosure will be easily understood by reference to accompanying drawings and following detailed descriptions.

BRIEF DESCRIPTION OF DRAWINGS

In order to clearly describe technical solutions in the embodiments of the present disclosure and technical solutions in the prior art, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor. In the drawing.

In the drawings.

1—groove support; 2—first hinge; 201—first bending plate; 202—second bending plate; 203—first rod body; 3—flat plate support; 4—second hinge; 401—third bending plate; 402—fourth bending plate; 403—second rod body; 5—mirror plate; 6—cross-shaped aiming line; 7—base; 8—correcting line; 9—calibrating hole; 10—supporting bending plate.

DETAILED DESCRIPTION

In the following descriptions, certain exemplary embodiments are briefly described. As may be recognized by those skilled in the art, the described embodiments may be modified in a variety of ways without departing from the spirit or scope of the present disclosure. Accordingly, the accompanying drawings and descriptions are considered to be exemplary rather than limiting in nature.

Embodiments of the present disclosure are described in detail below in conjunction with the accompanying drawings.

Figure 1:
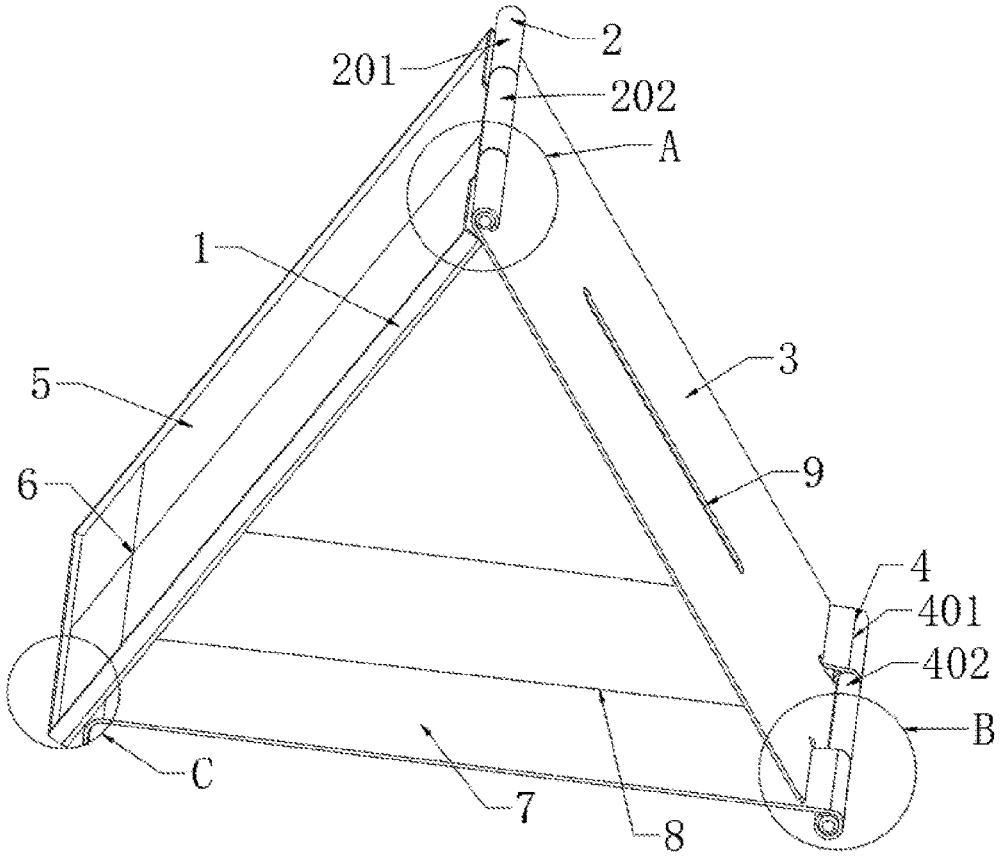
FIG. 1 is a schematic diagram of a golf putting sight of the present disclosure.
Figure 2:
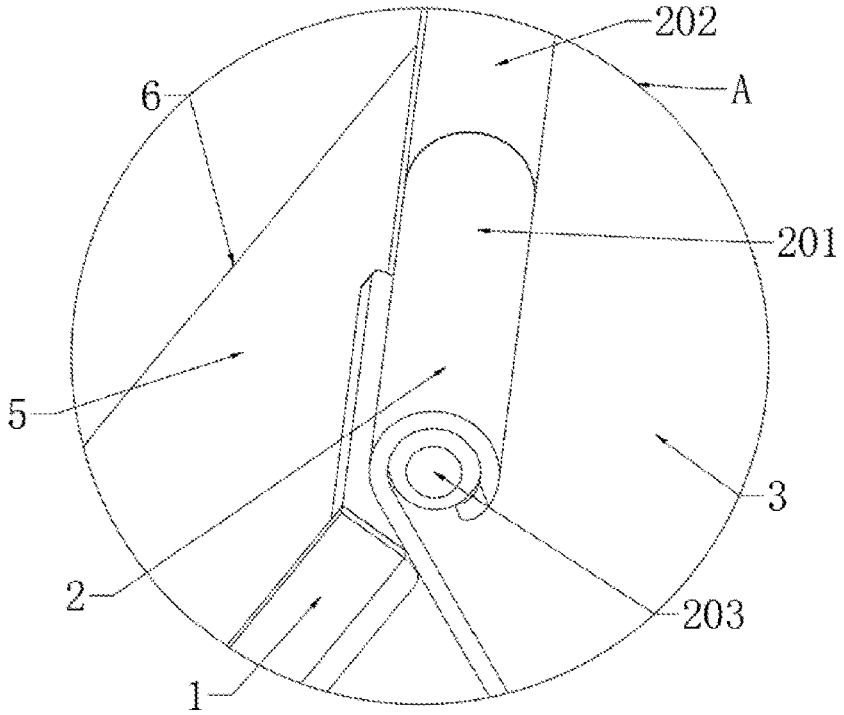
FIG. 2 is an enlarged schematic diagram of area A shown in FIG. 1.
Figure 3:
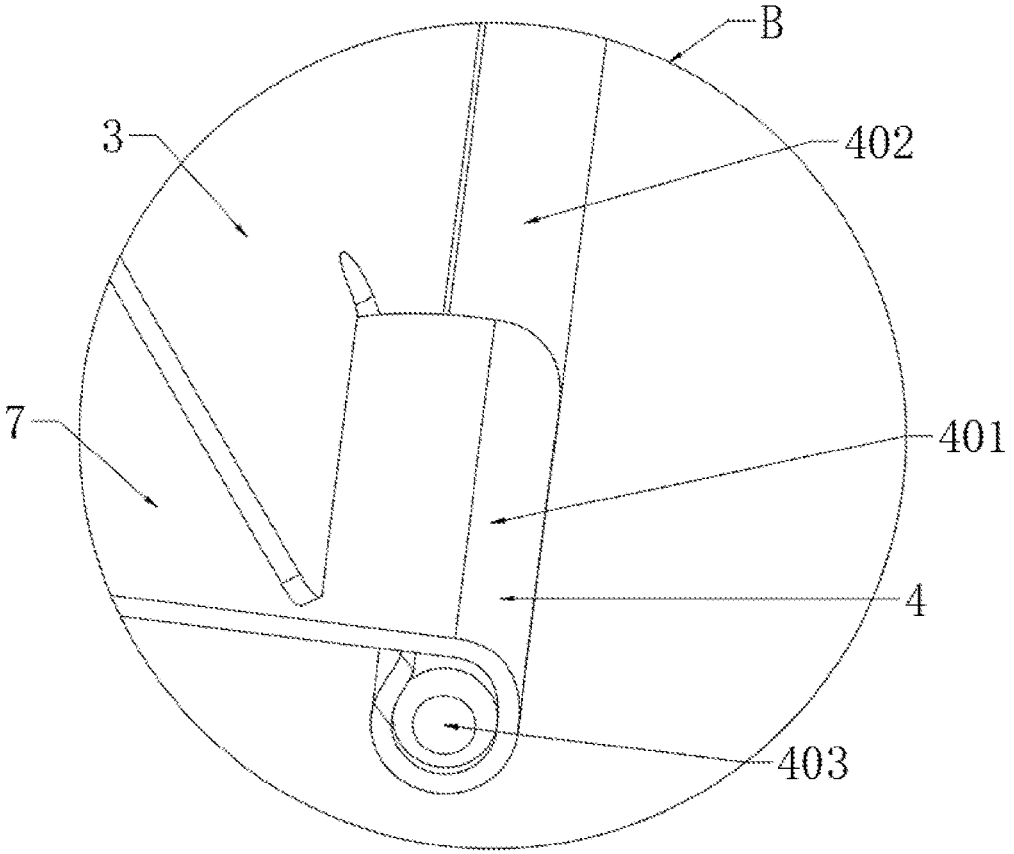
FIG. 3 is an enlarged schematic diagram of area B shown in FIG. 1.
Figure 4:
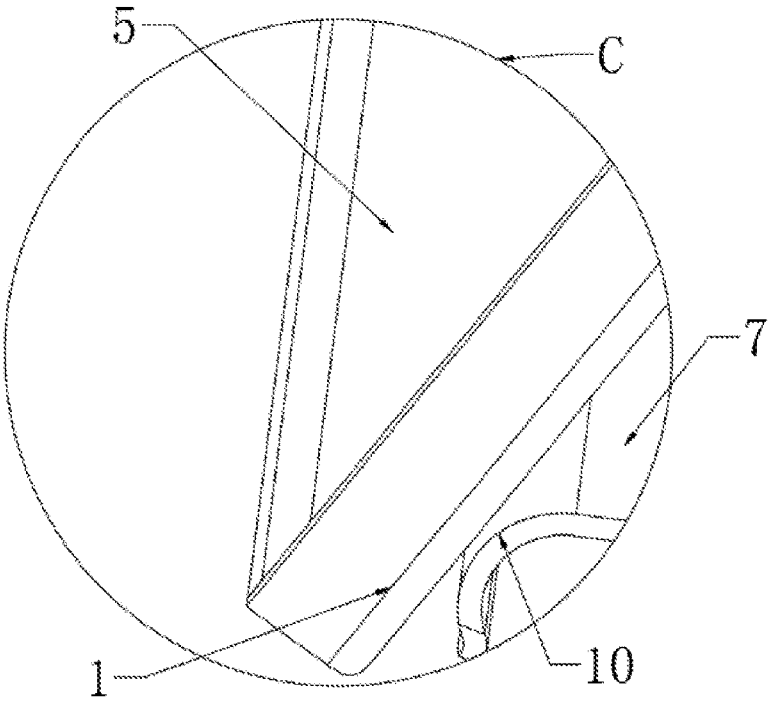
FIG. 4 is an enlarged schematic diagram of area C shown in FIG. 1.
Figure 5:
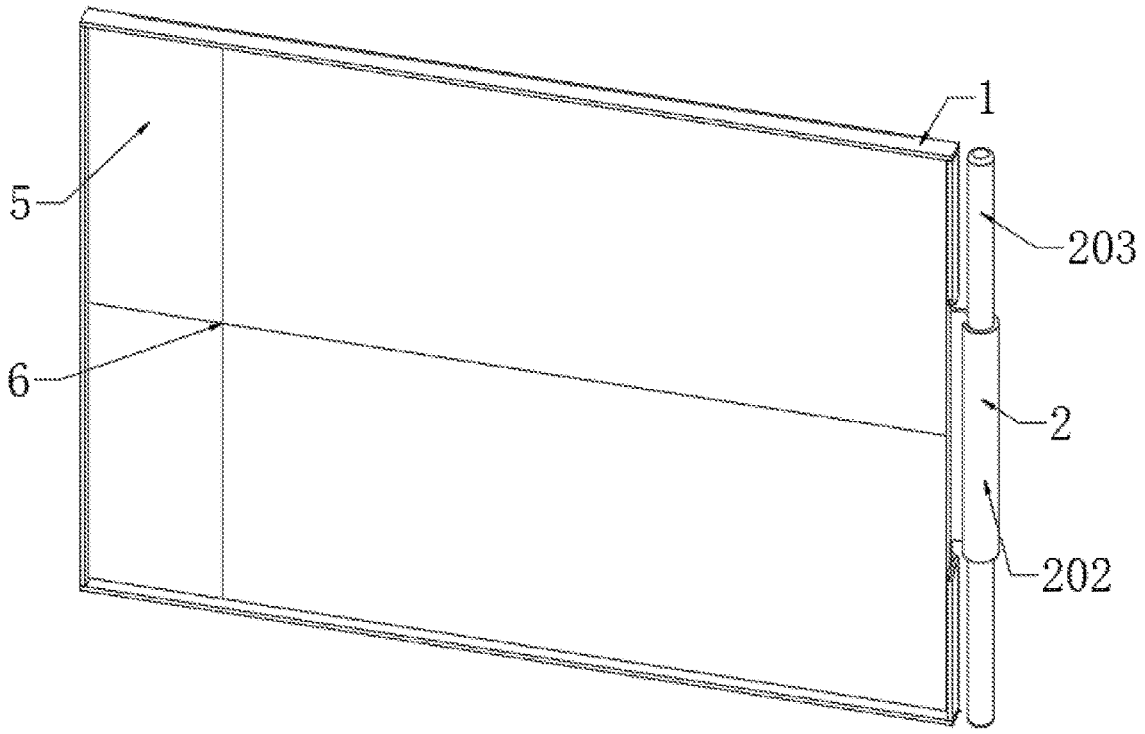
FIG. 5 is a schematic diagram of a groove support and first bending plates of the present disclosure where the groove support is connected to the first bending plates.
Figure 6:
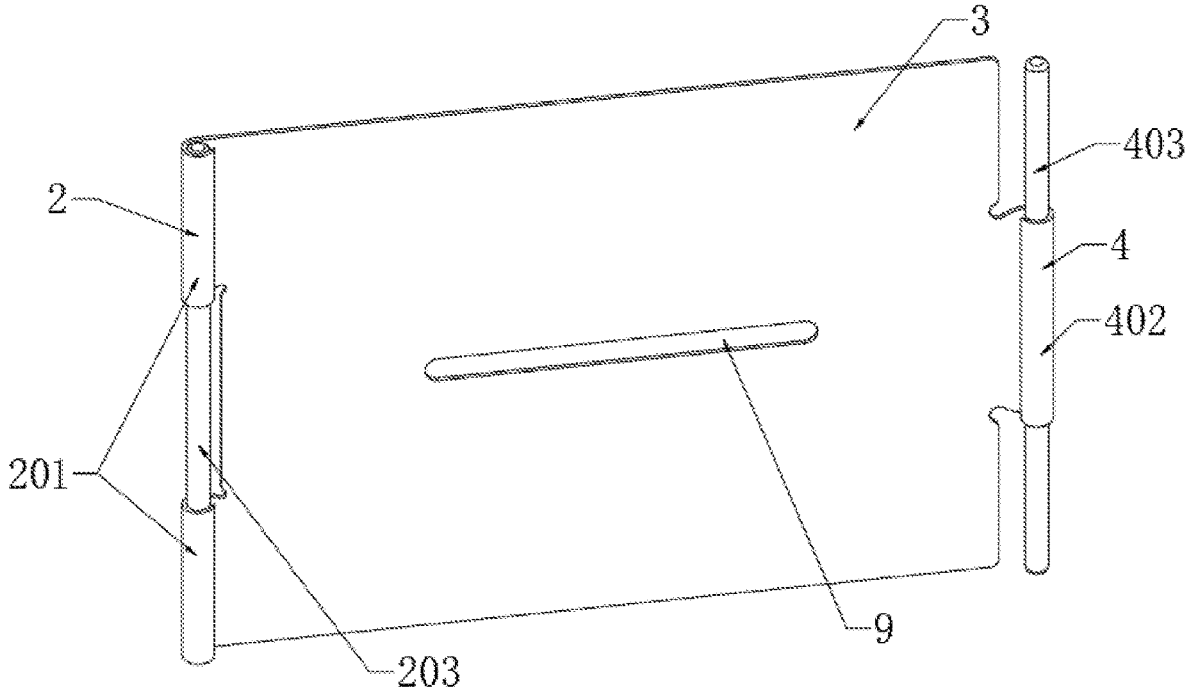
FIG. 6 is a schematic diagram of a flat plate support and a fourth bending plates of the present disclosure where the flat plate support is connected to the fourth bending plate.
Figure 7:
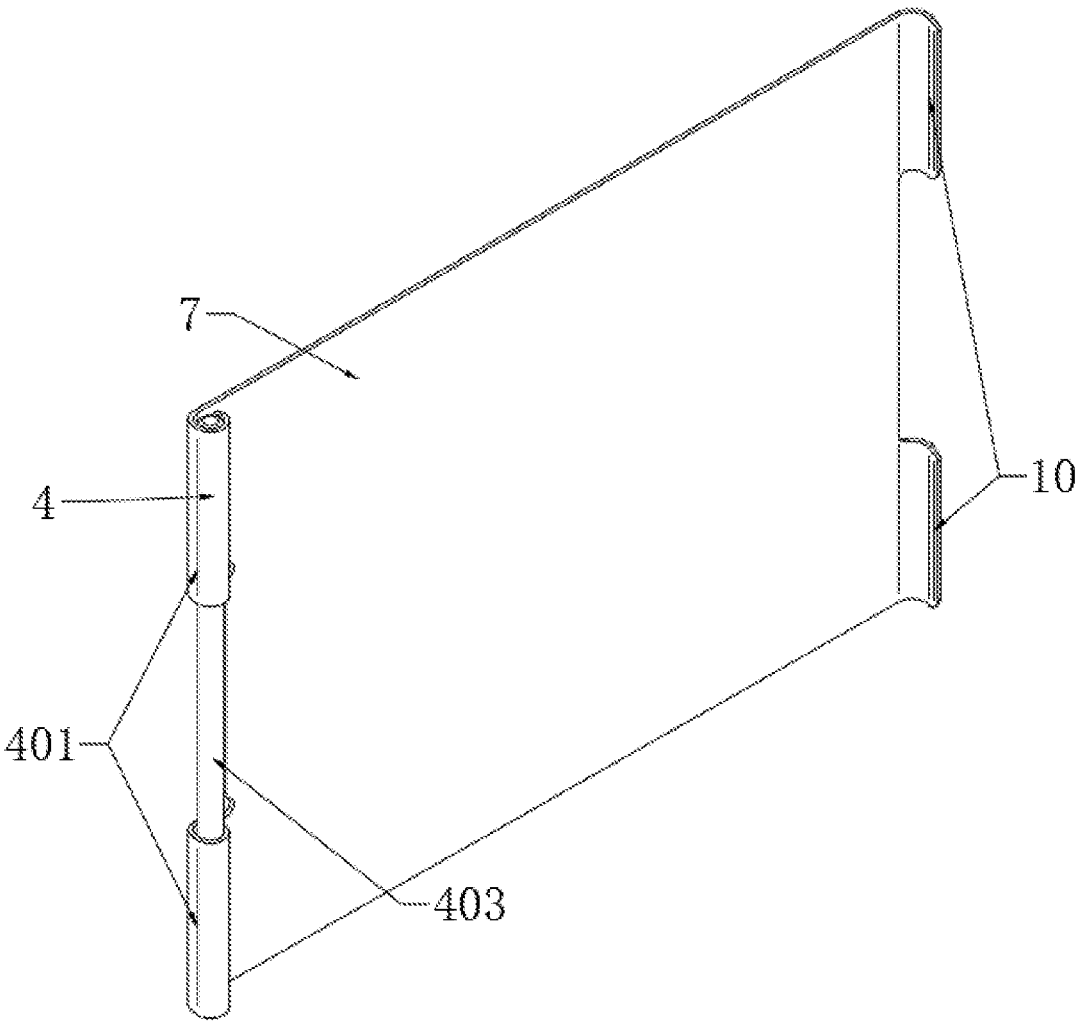
FIG. 7 is a schematic diagram of a base and third bending plates of the present disclosure where the base is connected to the third bending plates.
Figure 8:
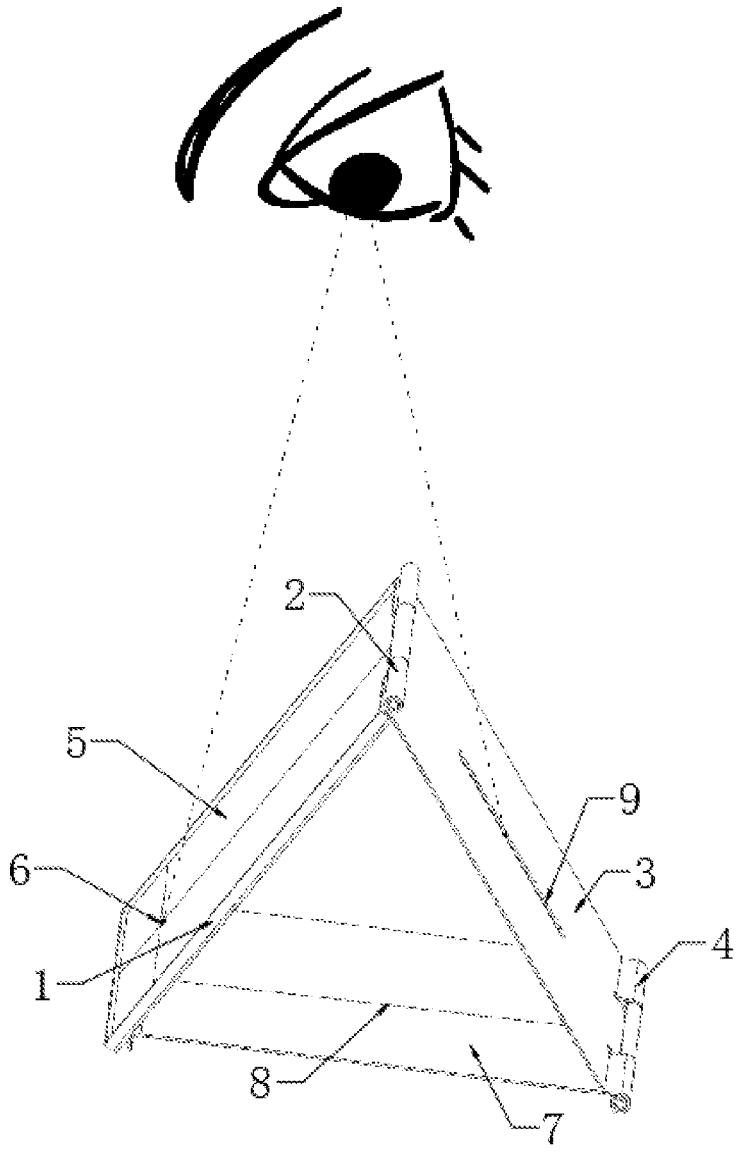
FIG. 8 is a schematic diagram of the golf putting sight shown in a configuration of use.
Figure 9:
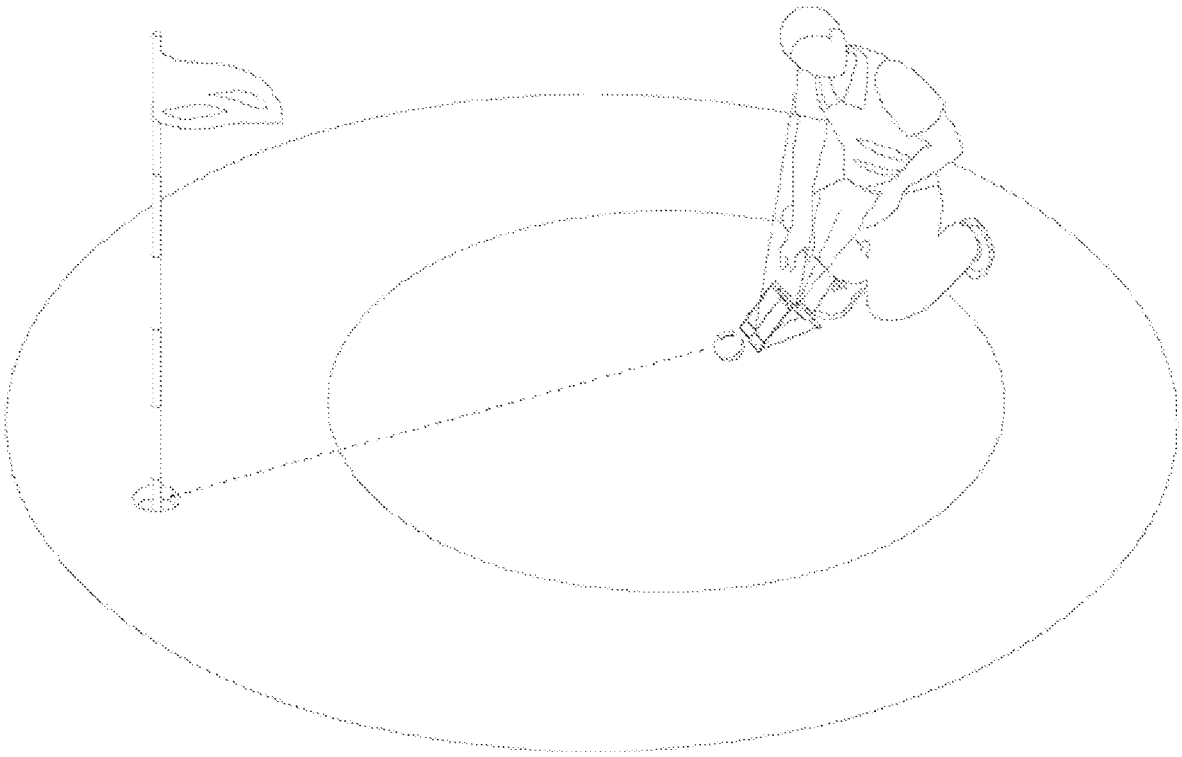
FIG. 9 is a schematic diagram showing a use environment of the golf putting sight of the present disclosure.

As shown in FIGS. 1-9, one embodiment of the present disclosure provides a golf putting sight. The golf putting sight comprises a groove support 1, a first hinge 2, and a flat plate support 3. One side of the groove support 1 is rotatably connected to the flat plate support 3 through the first hinge 2. A first side of the flat plate support 3 is rotatably connected to a base 7 through a second hinge 4. A mirror plate 5 is mounted in the groove support 1. Across-shaped aiming line 6 is arranged on one side of the mirror plate 5. One side of the flat plate support 3 defines a calibrating hole 9. A correcting line 8 is on an upper surface of the base 7.

In one embodiment, the first hinge 2 comprises two first bending plates 201, a second bending plate 202, and a first rod body 203. The one side of the groove support 1 is integrally formed on one side of the second bending plate 202. The first side of the flat plate support 3 is integrally formed on one side of each of the first bending plates 201. An inner wall of the second bending plate 202 is attached to an outer wall of the first rod body. An inner wall of each of the first bending pates 201 is attached to the outer wall of the first rod body 203. The first bending plates 201, the second bending plate 202, and first rod body 203 are combined to assist rotations of the groove support 1 and the flat plate support 3. The first bending plates 201, the second bending plate 202, and first rod body 203 limit a rotating position of the groove support 1 and a rotating position of the flat plate support 3.

In one embodiment, the second hinge 4 comprises two third bending plates 401, a fourth bending plate 402, and a second rod body 403.

A second side of the flat plate support 3 is integrally formed on one side of the fourth bending plate 402. One side of the base 7 is integrally formed on one side of each of the third bending plates 401. An inner wall of the fourth bending plate 402 is attached to an outer wall of the second rod body 403. An inner wall of each of the third bending pates 401 is attached to the outer wall of the second rod body 403. The third bending plates 401, the fourth bending plate 402, and second rod body 403 are combined to assist rotations of the base 7 and the flat plate support 3. The third bending plates 401, the fourth bending plate 402, and second rod body 403 limit a rotating position of the base 7 and the rotating position of the flat plate support 3.

In one embodiment, a supporting bending plate 10 is integrally formed on a second side of the base 7. By an arrangement of the supporting bending plate 10, a height of the supporting bending plate 10 is same as a height of the third bending plates 401, ensuring that the base 7 is placed in a horizontal position on the ground.

When in use, through the first hinge 2 and the second hinge 4, the groove support 1, the flat plate support 3, and the base 7 are convenient to form a triangular shape. Then the golf putting sight is placed on an opposite direction from a hole or a target and the golf putting sight is placed as close to a golf ball as possible without touching the golf ball. The base 7 is placed on the ground and the mirror plate faces the hole or the target. Then the golf ball is taken away and the golfer is able to look down from a top of the golf putting sight and the correcting line 8 on the base 7 is observed through the calibrating hole 9 of the flat plate support 3.

Ensuring that the correcting line 8 is aligned with the calibrating hole 9, and the golf putting scope of the present disclosure is rotated, so that the cross-shaped aiming line 6 of the mirror plate 5 is aligned with the hole or the target. During this process, it is necessary to ensure that the correcting line 8 is always aligned with the calibrating hole 9. After the cross-shaped aiming line 6 of the mirror plate 5 is aligned with the hole or the target, the golf ball is put back in place, so that the aiming line on the golf ball is aligned with the cross-shaped aiming line 6 of the mirror plate 5. Then the golfer takes away the golf putting sight of the present disclosure to complete the aiming and hits the golf ball into the hole.

The above described is only a specific embodiment of the present disclosure, and the protection scope of the present disclosure is not limited thereto. Those skilled in the art can easily think of various variations or substitutions thereof within the technical scope disclosed in the present disclosure, and these variations or substitutions fall within the protection scope of the present disclosure. Therefore, the protection scope of the present disclosure shall be subject to the protection scope of the attached claims.

What is claimed is:

1. A golf putting sight, comprising:

a groove support, a first hinge, and a flat plate support;

wherein one side of the groove support is rotatably connected to the flat plate support through the first hinge; a first side of the flat plate support is rotatably connected to a base through a second hinge; a mirror plate is mounted in the groove support; a cross-shaped aiming line is arranged on one side of the mirror plate; one side of the flat plate support defines a calibrating hole; a correcting line is on an upper surface of the base.

2. The golf putting sight according to claim 1, wherein the first hinge comprises two first bending plates, a second bending plate, and a first rod body; the one side of the groove support is integrally formed on one side of the second bending plate; the first side of the flat plate support is integrally formed on one side of each of the first bending plates, an inner wall of the second bending plate is attached to an outer wall of the first rod body; an inner wall of each of the first bending pates is attached to the outer wall of the first rod body.

3. The golf putting sight according to claim 1, wherein the second hinge comprises two third bending plates, a fourth bending plate, and a second rod body; a second side of the flat plate support is integrally formed on one side of the fourth bending plate; one side of the base is integrally formed on one side of each of the third bending plates; an inner wall of the fourth bending plate is attached to an outer wall of the second rod body; an inner wall of each of the third bending pates is attached to the outer wall of the second rod body.

4. The golf putting sight according to claim 1, wherein a supporting bending plate is integrally formed on a second side of the base.

* * * * *